US005526938A

United States Patent [19]

Kraft et al.

[11] Patent Number: 5,526,938

[45] Date of Patent: Jun. 18, 1996

[54] VERTICAL ARRANGEMENT FLUIDIZED/NON-FLUIDIZED BED CLASSIFIER COOLER

[75] Inventors: David L. Kraft, Canton; Michael J. Szmania, Medina, both of Ohio

[73] Assignee: The Babcock & Wilcox Company, New Orleans, La.

[21] Appl. No.: 320,077

[22] Filed: Oct. 7, 1994

[51] Int. Cl.[6] ..... B07B 4/00; F26B 3/00; F26B 21/00

[52] U.S. Cl. ..... 209/139.1; 209/474; 34/371; 34/446; 34/565; 34/589

[58] Field of Search ..... 209/133, 139.1, 209/138, 142, 474; 34/371, 434, 431, 446, 451, 565, 576, 589

[56] References Cited

U.S. PATENT DOCUMENTS 3,079,222 2/1963 Reeve ..... 209/474 X
3,161,485 12/1964 Buhrer ..... 34/431 X
3,831,747 8/1974 Scott et al. ..... 209/138 X
4,624,059 11/1986 Hammarskog et al. ..... 34/565 X
5,299,694 4/1994 Rambaud ..... 209/139.1 X

*Primary Examiner*—William E. Terrell
*Assistant Examiner*—Tuan Nguyen
*Attorney, Agent, or Firm*—Daniel S. Kalka; Robert J. Edwards

[57] ABSTRACT

A system for classifying and cooling particulate material produced by a fluid bed boiler comprises a vertical housing having an inlet for incoming particulate material and a first outlet for discharging exhaust and a second outlet for discharging solids. A fluidized bed of material is contained within the housing and is located directly above a bed of material. A gas distribution grid provides air to both beds for cooling the particulate material, and temperature measurement is used along with flow measurement to control gas velocity through the beds.

3 Claims, 1 Drawing Sheet

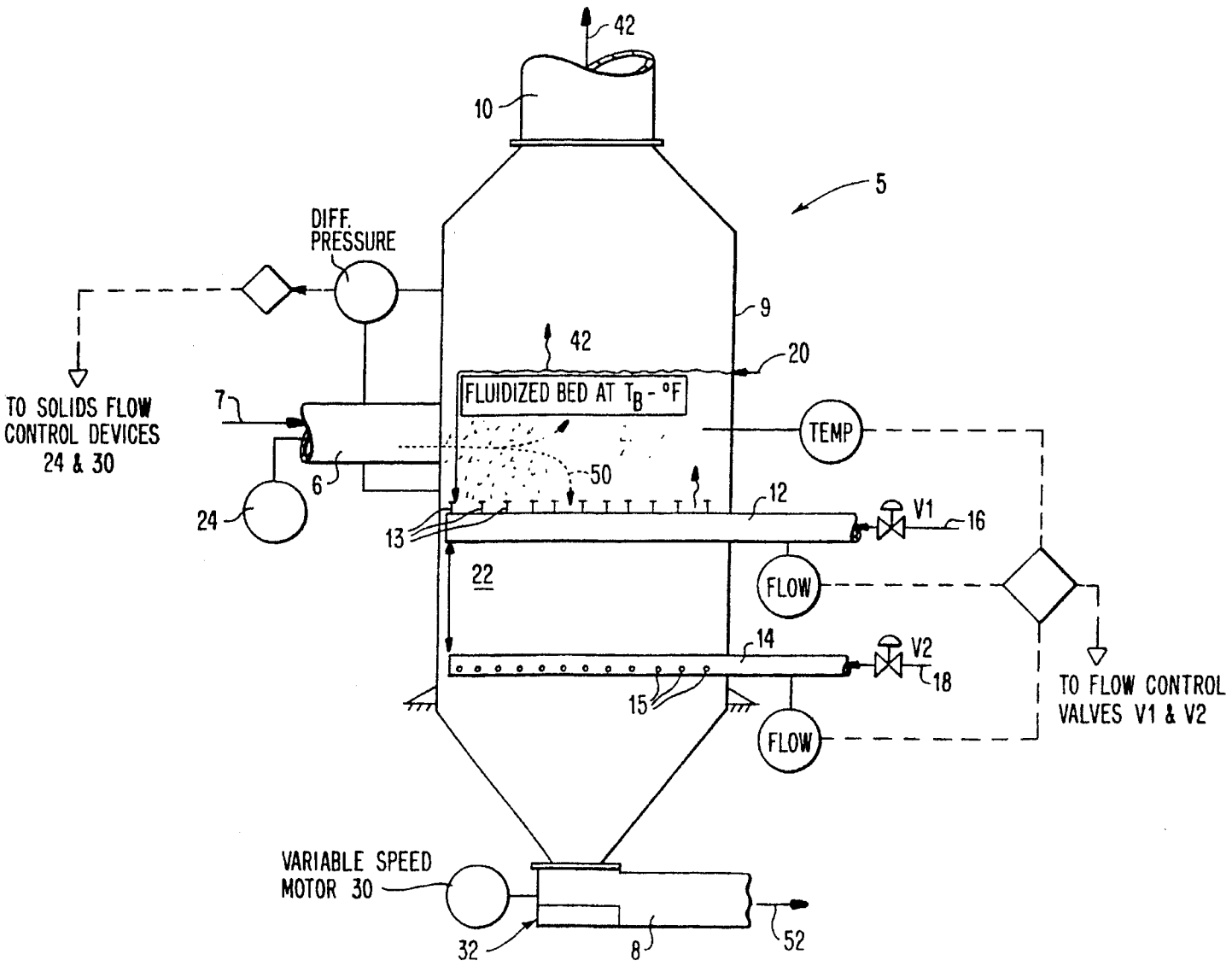
TO FLOW CONTROL VALVES V1 & V2
V1
V2
16
18
TEMP
FLOW
FLOW
5
20
9
12
14
52
42
FLUIDIZED BED AT $T_B$ - °F
50
15
8
10
22
32
13
DIFF. PRESSURE
6
VARIABLE SPEED MOTOR 30
7
24
TO SOLIDS FLOW CONTROL DEVICES 24 & 30

VERTICAL ARRANGEMENT FLUIDIZED/NON-FLUIDIZED BED CLASSIFIER COOLER

BACKGROUND OF THE INVENTION

1. Field of the Invention

The present invention relates, in general, to particulate classification systems and, in particular, to a new and useful system and method for classifying and cooling, or cooling only, particulate material utilizing a plurality of material beds and gas to solids contact heat exchange.

2. Description of the Related Art

There are various known systems and methods for separating or classifying particulate material produced by combustion processes such as those related to fluid bed boilers. Additionally, there are many known devices and processes which are utilized in order to cool these combustion products by heat exchange.

Presently, there is no known system or method which provides for a combined classifying and cooling of combustion products in a single vertical housing using a plurality of beds of particulate material.

SUMMARY OF THE INVENTION

The present invention is a system and method for classifying and cooling, through heat exchange, particulate material produced from combustion processes such as fluid bed boiler processes.

The present invention utilizes a vertical housing having an inlet for incoming combustion product and a first outlet at an upper end of the housing for discharging air and fines and a second outlet at the bottom of the housing for discharging cooled solids. The vessel includes a plurality of beds of particulate material such as a fluidized bed and a particle bed located beneath the fluidized bed. Cooling gas is provided to the fluidized bed and the particle bed for cooling the particulate material. The cooling gas allows for gas to solids contact heat exchange in an overall countercurrent arrangement. Large debris and particulate are removed from the housing at the bottom of the housing. Temperature, pressure, and flow measurement systems are utilized to control solids throughout and inventory of the device and gas velocity through the particulate beds in the device.

It is an object of the present invention to provide a classification and heat exchange system and method which is in a vertical configuration, has multiple particulate material beds, utilizes gas to solids contact heat exchange in an overall countercurrent arrangement and incorporates an open bottom in the vertical housing in order to facilitate the removal of large size particles and debris.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The drawing is a schematic view illustrating a classifying and cooling system for particulate material according to the present invention.

DESCRIPTION OF THE PREFERRED EMBODIMENTS

Referring to the drawing, the present invention incorporated therein in schematic form comprises a system, generally designated (5), which is a vertical stacked fluidized bed (20) and particle bed (22) arrangement in a combined particle classifier and cooler.

System (5) utilizes a vertical housing (9) having multiple beds, i.e. fluidized bed (20) positioned above bed (22). Both beds (20) and (22) are composed of particulate material (7), such as hot combustion product, which is fed into the housing through inlet (6) from a main external process such as a fluidized bed boiler. Gas media, i.e. cooling air (16) and (18), is passed through the beds (20) and (22) in order to serve as the cooling media and can be any selected gas, including air, which has been adequately compressed and metered to pass through the particle beds (20) and (22).

The fluidized bed section (20) is located above the section (22). Final fluidization velocity of the total cooling and fluidizing media (16 plus 18) in the section (20) is set to remove particle sizes around and smaller than a selected value. Fluidizing area (20) is set as a function of the maximum design exhaust temperature of the exhaust stream (42), mass flow of total cooling and fluidizing media (16 and 18), design solids throughput rate, and the final fluidizing velocity which is determined based on the selected top size of the particles to be stripped from the incoming solids stream (7). These design parameters are selected based on design requirements of the main process that the device (5) supports.

Typically, inlet solids with a mean particle size of 400 microns will require a superficial bed gas velocity of 5.0 to 6.0 feet per second, through a 825° F. fluidized bed, to elutriate the majority of the 325 micron and smaller material.

Area of the section (22) is a function of both the average particle size of solids (50) (which establishes minimum fluidizing velocity) and the maximum exhaust temperature for the section (22) which is determined from a heat and material balance for the device (5). The area (22) is set to prevent the heated cooling media (18) from attaining minimum fluidization velocity prior to it exiting the section (22) into the fluidized section (20). Cooling media gas flow rate (18) is set to attain a desired final exit temperature for the solids stream (52) at the exit (8) from the device (5).

Typically, for particles of a material such as sand with a mean particle size of 750 microns and an average inlet temperature of 800° F. at the top of section (22), the minimum fluidization velocity will be in the range of 1.0 to 2.0 feet per second if air is the cooling media and it has attained a temperature in the range of 750° F. to 800° F. on passage through the bed (22).

Each of the two beds (20) and (22) receives cooling media (16) and (18) from a distribution grid consisting of discrete air pipes (12) and (14) having openings (15) or nozzles (13) and located at the bottom of that bed. In addition, the fluidized bed section (20) receives the exhaust of the bed cooling media (18). The cooling media distribution grid (14) in the section (22) disperses the media (18) to achieve uniform distribution into the solids for contact cooling and leaves open areas for particulate material and debris (50) to pass through enroute to the solids exit point (8) from the device (5). The cooling media distribution grid (12) for the fluidized bed section (20) provides distribution for even fluidization and also allows for particulate material and debris (50) to pass out of the fluidized bed (20) while allowing heated exhaust gas from section (22) to enter the fluidized bed section (20).

Generally, hot particulate solids (7) from a main process, such as a fluid bed boiler, are fed into the housing (9) near the top of the device (5) via a controller (24) such as an L-valve or other metering device. The solids (7) are then routed through the first fluidized bed section (20), then bed (22), and finally, exit the bottom of the device (5) at outlet (8) through a metering controller (30) which utilizes a device such as a screw conveyor or rotary feeder (32). That is, solids throughput rate and fluidized bed level (20) are controlled by varying solids flow (7) through the inlet (6) with control device (24), and by varying the speed of device (30). Fluid bed level measurement can be accomplished by different methods, one of which is differential pressure measurement, as shown schematically on the illustrative drawing.

The design velocity in the fluidized bed section (20) is set to cause elutriation of the desired particle size range and cooling of the remaining particles from the hot solids inlet stream (7) to some intermediate temperature. Temperature of the exhaust stream (42) is measured and used to control inlet cooling gas flows (16) & (18) so that a desired range of gas velocity is maintained in the fluid bed section (20). Generally, a greater portion of the total cooling and fluidizing media flow (16 plus 18) can be supplied as fluidizing flow (16) at reduced solids throughput rates through device (5).

Total cooling and fluidizing media flow (16 plus 18) is set to produce a desired temperature of the exhaust flow (42) that is at or below a selected maximum design temperature when solids flow rate (7) to the device (5) is at design maximum. This maximum temperature of exhaust stream (42) is based on requirements of the main process, heat and material balance for the device (5), desired size range of particles to be removed from the incoming solids stream, and mechanical design considerations for the outlet (10) construction. Exhaust (42), which is a combination of gas and particulate fines, is channeled from the housing at outlet (10).

The solids and debris (52) which are not elutriated and exhausted to the main process move downward through the device (5), pass through the fluidized bed cooling media distribution grid (12), and into bed section (22). Here they are further cooled by contact with the cooling media (18). The cooled solids and debris (52) then pass out the bottom of the device outlet (8).

Hot particulate solids (7) from the main process fluid bed boiler are routed to the top or side of the classifier/cooler (5) where they are metered into the device via control device (24) such as an L-valve. The solids (7) are fed either into the fluidized bed cooling media exhaust (42) or into the fluidized bed (20) itself. When fed into the exhaust stream (42), some of the desired size particles are immediately stripped from the incoming feed (7) and join those particles of the same size range which have been elutriated from the fluid bed (20). The remainder (52) of the incoming solids (7), or all the solids when in-bed feed is used, go into the fluid bed section (20). Contact cooling to some intermediate design temperature and the majority of desired particle separation, in the form of elutriation, occur in the fluid bed section (20). Contact cooling in section (22) lowers the temperature of the disposal solids stream (52) to a design selectable end temperature before it exits the contact cooler (22) and passes out of the device outlet (8).

While specific embodiments of the invention have been shown and described in detail to illustrate the application of the principles of the invention, it will be understood that the invention may be embodied otherwise without departing from such principles.

What is claimed is:

1. A system for classifying and cooling particulate material produced by a process, the system comprising:

a vertical housing having an inlet for incoming particulate material and a first outlet at a top of the housing for discharging air and fines and a second outlet at a bottom of the housing for discharging cooled solids;

a first fluidized bed of particulate material in the housing;

a second bed of particulate material in the housing located below the first fluidized bed;

means for providing cooling gas to the first fluidized bed and the second bed; and means for using temperature measurement and flow measurement to control cooling gas velocity in the first fluidized bed and second bed.

2. The system according to claim 1, wherein the cooling gas means comprises a plurality of distribution pipes having a plurality of openings for passing the cooling air into the housing.

3. A method for classifying and cooling particulate material produced by a process, the method comprising the steps of:

channeling the particulate material into a vertical housing;

providing a first outlet at a top of the housing for discharging gas and fines;

providing a second outlet at a bottom of the housing for discharging cooled solids;

establishing a first fluidized bed in the housing by fluidizing a portion of the particulate material;

establishing a second bed in the housing with a remaining portion of the particulate material;

cooling the first fluidized bed and the second bed with a cooling gas;

controlling the velocity of the cooling gas in the first fluidized bed and the second bed with temperature and flow measurement means;

channeling heated gas and fines through the first outlet of the housing; and channeling cooled solids through the second outlet of the housing.

* * * * *